US006572085B2

(12) United States Patent
Bloemer

(10) Patent No.: US 6,572,085 B2
(45) Date of Patent: Jun. 3, 2003

(54) HUMIDIFIER WITH REVERSIBLE HOUSING AND DISTRIBUTION TRAY OVERFLOW

(75) Inventor: John M. Bloemer, Sun Prairie, WI (US)

(73) Assignee: Research Products Corporation, Madison, WI (US)

( * ) Notice: Subject to any disclaimer, the term of this patent is extended or adjusted under 35 U.S.C. 154(b) by 0 days.

(21) Appl. No.: 09/858,173

(22) Filed: May 15, 2001

(65) Prior Publication Data

US 2002/0171158 A1 Nov. 21, 2002

(51) Int. Cl.[7] ..... B01F 3/04

(52) U.S. Cl. ..... 261/97; 261/106; 261/DIG. 44; 126/113

(58) Field of Search ..... 261/97, 98, 99, 261/103, 104, 106, 107, DIG. 41, DIG. 44, DIG. 46; 126/113

(56) References Cited

U.S. PATENT DOCUMENTS 3,171,401 A * 3/1965 McDuffee ..... 261/DIG. 44
3,823,926 A * 7/1974 Bracich ..... 261/106
4,125,576 A 11/1978 Kozinski ..... 261/106
5,211,891 A * 5/1993 Anoszko ..... 261/106
5,252,260 A 10/1993 Schuman ..... 261/106
5,851,444 A * 12/1998 Hansell, Jr. et al. ..... 261/97
5,853,625 A * 12/1998 Kensok et al. ..... 261/106
5,932,148 A * 8/1999 Hansell, Jr. et al. ..... 261/97
6,354,572 B1 * 3/2002 Menassa ..... 261/106
6,367,782 B1 * 4/2002 Guetersloh ..... 261/106
6,394,427 B1 * 5/2002 Guetersloh et al. ..... 261/99

* cited by examiner

*Primary Examiner*—C. Scott Bushey
(74) *Attorney, Agent, or Firm*—Andrus, Sceales, Starke & Sawall, LLP

(57) ABSTRACT

A humidifier features a two piece reversible housing which is snap fit together for holding a water panel assembly and a water feed tube to supply water to a water distribution structure disposed on top of the water panel assembly. The water panel assembly is provided with an overflow arrangement for controlling any overflow of water in the water distribution structure.

7 Claims, 5 Drawing Sheets

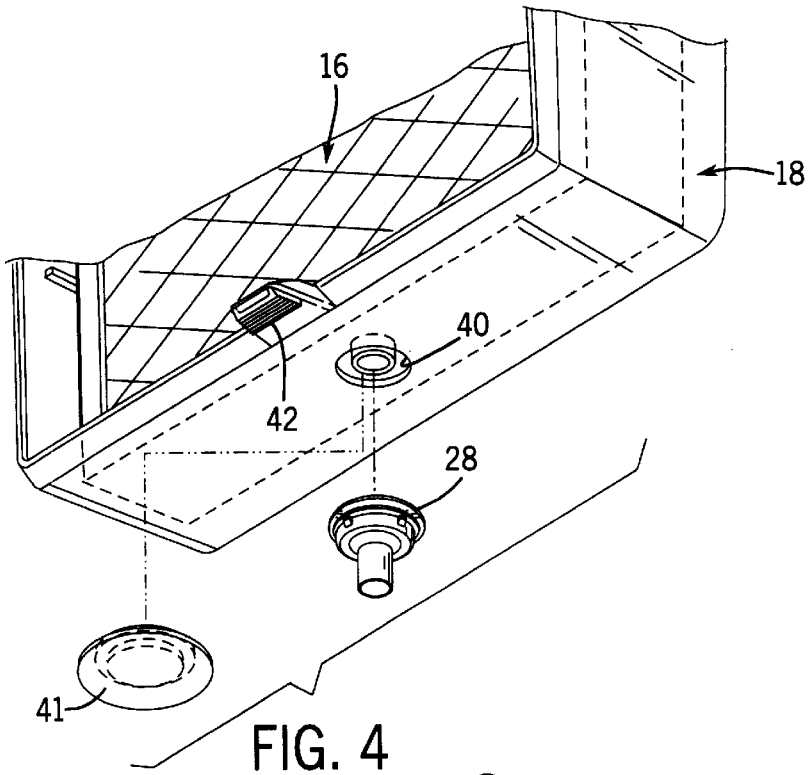
FIG. 4
FIG. 5
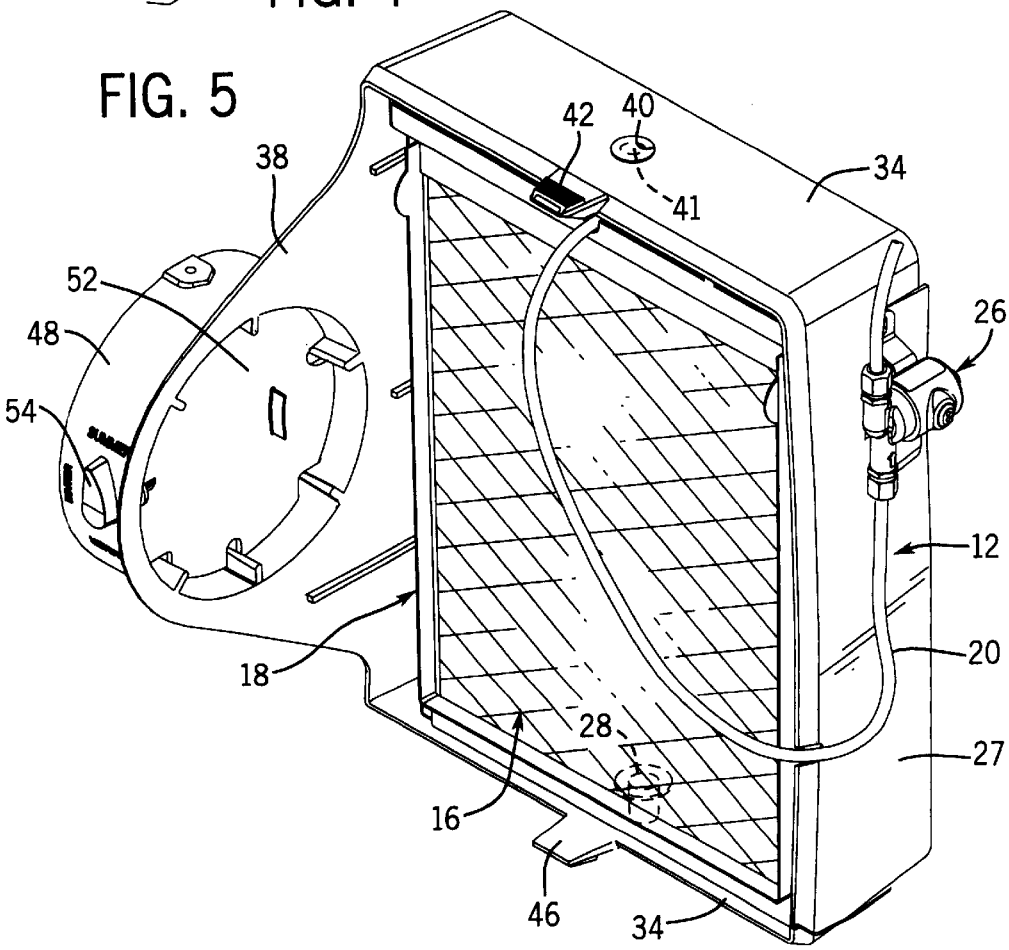

HUMIDIFIER WITH REVERSIBLE HOUSING AND DISTRIBUTION TRAY OVERFLOW

FIELD OF THE INVENTION

This invention relates generally to humidifiers such as used in conjunction with a furnace or heating system and connected to a plumbing system of a building. Humidifiers of this type generally use an air circulation arrangement to move air across a water soaked evaporation pad. The humidifier is associated with the furnace or heating system so that the humidifier moist air can be combined with the warm, generally dry, heated air and distributed through a building.

BACKGROUND OF THE INVENTION

Humidifiers are generally characterized by a housing having an evaporative water panel constructed of slit and expanded media removably disposed therein. A water feed tube is connected to a water supply for supplying water via a solenoid valve to a distribution tray from which water flows downwardly by gravity through the water panel. Air is forced through the water panel and the air evaporates water on the water panel so that humidified air is delivered to the building.

One such prior art humidifier is disclosed in U.S. Pat. No. 4,125,576 issued Nov. 14, 1978 to Kozinski. In this patent, an evaporative pad is mounted in a three part enclosure consisting of a housing having a furnace duct adapter on one side and plumbing on the other, a water distribution tray removably mounted on top of the housing and a drain pan removably fastened to the bottom of the housing. A water supply means is provided for supplying water to the distribution tray.

Sometimes, because of the location of the furnace piping or plumbing, it is necessary or desirable to turn or reverse the housing so that the plumbing and the air duct adapter are on opposite sides. To accomplish this, the distribution tray and drain pan must be removed from the housing by loosening various thumb screws, and then the housing must be removed and rotated 180 degrees. Once this is done, the housing is reinstalled and the distribution tray is then fastened to the bottom of the housing and the drain pan mounted on the top of the housing. This prior art humidifier thus requires manipulation of three separate components with a plurality of fasteners to accomplish the desired housing reversal.

In addition, prior art humidifiers such as shown in the '576 patent, sometimes encounter problems in the distribution tray overflowing due to plugged up flow structure or scale build up. In such event, water would leak from the housing and create unwanted puddles. In the worst case, overflow water would be blown through the duct system into the furnace elements causing damage thereto.

Accordingly, it is desirable to provide an improved humidifier housing which may be more easily connected and disconnected to effect a reversed orientation to adapt the various existing environmental structure. It is further desirable to provide an improved humidifier water distribution structure which more controllably handles overflow in the event of water obstruction and prevents damage to surrounding structure.

SUMMARY OF THE INVENTION

It is a general object of the present invention to provide a humidifier which consistently and efficiently delivers the correct amount of moisture as installed in a furnace system.

It is one object of the present invention to provide a humidifier having an easily reversible, two part housing which does not require loosening and tightening of fasteners.

It is also an object of the present invention to provide a humidifier having water distribution structure which reacts to any blockage in water by channeling overflow along a preferred path inside the housing to drain.

It is a further object of the present invention to provide a humidifier which is easier and less costly to manufacture and maintain.

In one aspect of the invention, a humidifier includes a base having an adapter in a first position adapted to be connected to a furnace duct. The base houses a water panel assembly and a water feed tube to supply water to a water distribution structure disposed on top of the water panel assembly. A cover is removably connected to the base. The base and the cover are rotatable independent of the water distribution structure to place the adapter in a second position to adapt to a different furnace duct, and the base and cover are snap fit together without fasteners. The base with the adapter in the first position has a top opening in which a cap is removably attached, and a bottom opening in which a drain spud is removably inserted. The base with the adapter in the second position has a top opening and the bottom opening interchanged such that the cap is removably fastened in the bottom opening, and the drain spud is removably inserted in the top opening. The base and the cover are provided with mating latch and catch structure on top and bottom portions thereof. The water panel assembly is comprised of a scale control insert, an evaporative water panel held within the scale control insert and a distribution tray retained within the scale control insert above the water panel. The scale control insert is formed with an upstanding skirt having opposing end panels formed with slots therein. A first upstanding vertical wall is parallel and spaced from a first side panel to form a first overflow channel therebetween. A second upstanding vertical wall is parallel and spaced from a second side panel to form a second overflow channel therebetween. Any excess water in the distribution tray will travel over the first and second walls into the first and second overflow channels and flow downwardly between the water panel and the end panels of the scale control insert to a drain. The distribution tray is provided with tabs which fit in the slots of the skirt. The distribution tray is sized to fit within the end panels and the vertical walls of the skirt.

In another aspect of the invention, a humidifier includes a base adapted to be connected to a furnace duct. The base houses a water panel in a water panel framework, and a water feed tube for supplying water to a distribution tray disposed in the water panel framework above the water panel. A cover is removably connected to the base. The water panel framework is provided with overflow structure for directing and confining any overflow of water in the distribution tray within the water panel framework. The overflow structure is comprised of a pair of overflow channels disposed longitudinally on opposite sides of the distribution tray.

In yet another aspect of the invention, a humidifier includes a two piece reversible housing snap fit together for holding a water panel assembly and a water feed tube to supply water to a water distribution structure disposed on top of the water panel assembly. The water panel assembly is provided with an overflow arrangement for controlling any overflow of water in the water distribution structure.

Various other features, objects and advantages of the invention will be made apparent from the following description taken together with the drawings.

BRIEF DESCRIPTION OF THE DRAWINGS

The drawings illustrate the best mode presently contemplated for carrying out the invention.

In the drawings:

FIG. 4 is a partial, bottom view of a humidifier base showing adaptability of a cap or drain spud therein;

FIG. 5 is a perspective view of a water panel assembly inside the humidifier base;

DETAILED DESCRIPTION OF THE INVENTION

Figure 1:
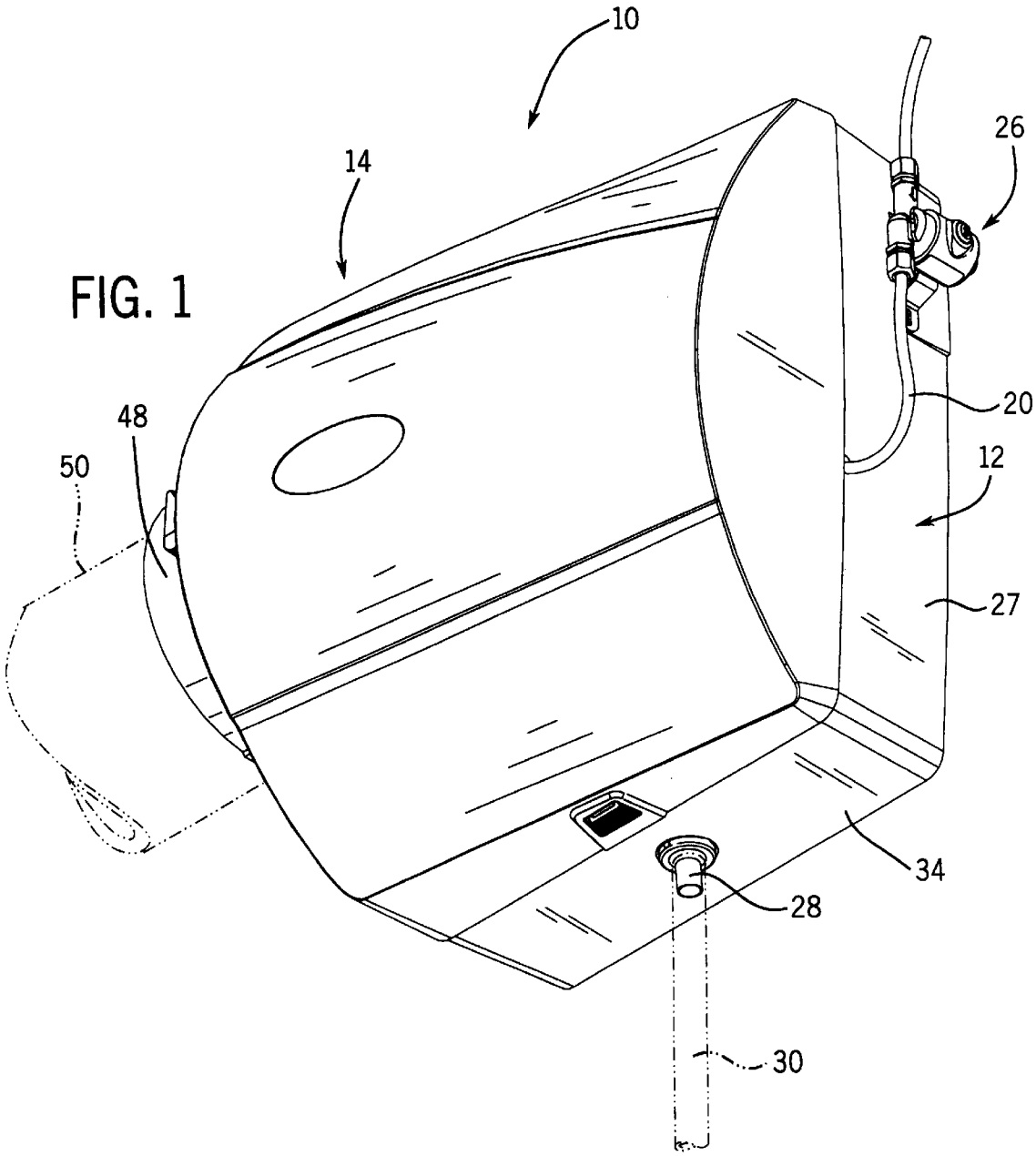
FIG. 1 is a perspective view of an assembled humidifier embodying the present invention.
Figure 2:
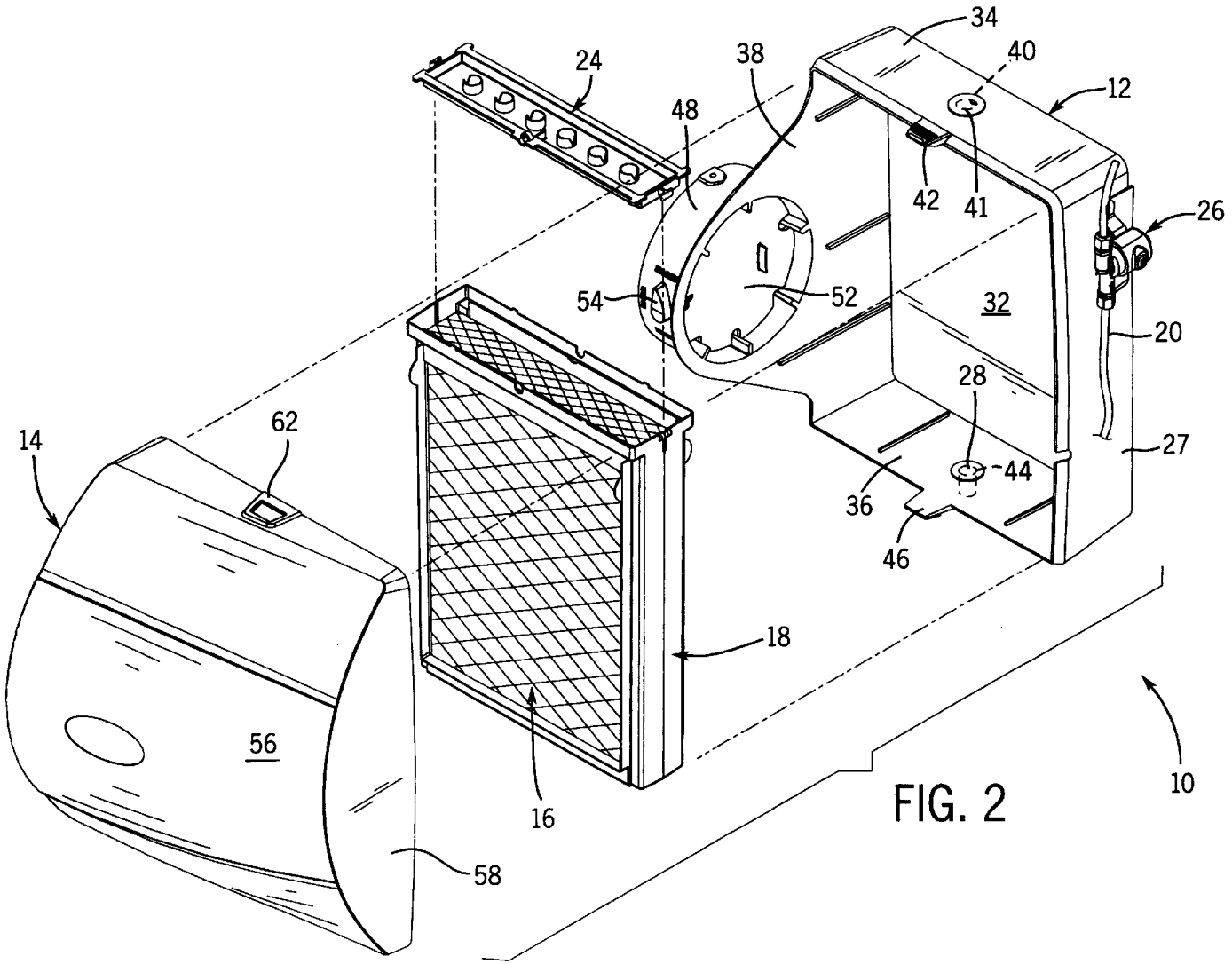
FIG. 2 is an exploded view of the humidifier of FIG. 1.

As seen in FIGS. 1 and 2, a humidifier 10 embodying the present invention includes a base 12 and a cover 14 which defines a two piece housing that is attached to a portion of a furnace. Base 12 holds an evaporative water panel 16 preferably formed of slit and expanded media mounted in a framework or scale control insert 18. The scale control insert 18 reduces the bypass around water panel 16 and contains the mineral deposits that build up upon water panel 16 as a result of the evaporative process. Base 12 also includes a water feed tube 20 retained by a holder 22 and having one end which supplies water to a removable distribution tray 24 (FIG. 7) for the water panel 16. Another end of the feed tube 20 is joined to a solenoid valve 26 mounted on a side wall 27 of the base 12 for controlling the flow of water through the feed tube 20. Solenoid valve 26 is, in turn, permanently connected to the plumbing or water supply of a building. Although not shown, it should be understood that the humidifier 10 is associated with air circulation means, such as a fan or blower, for directing air through the wetted water panel 16. A humidistat (also not shown) is commonly used to establish a desired humidity set point. Water drainage from water panel 16 is discharged to a drain spud 28 and a drain 30 connected thereto.

Figure 3:
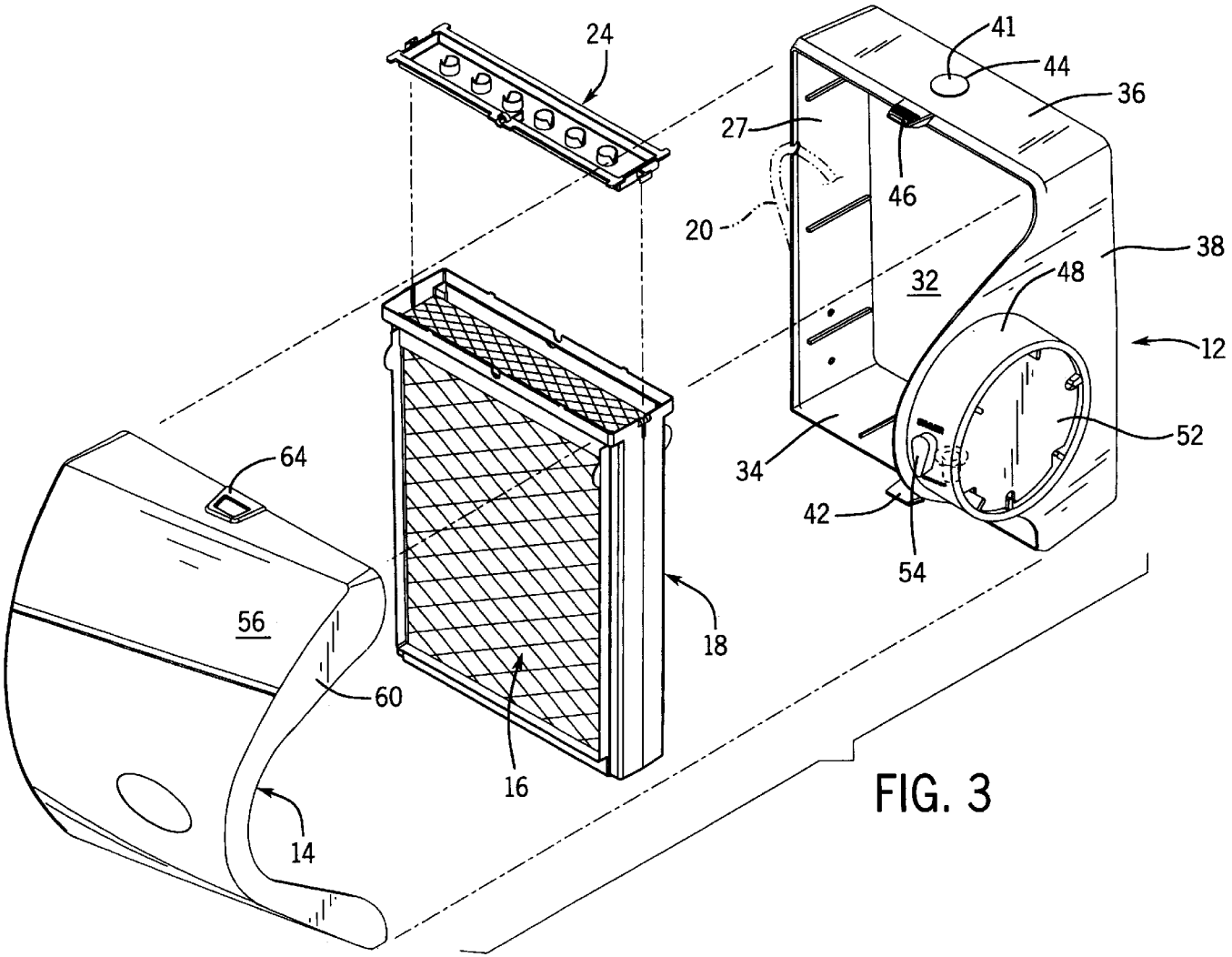
FIG. 3 is a view similar to FIG. 2 showing a housing of the humidifier rotated 180 degrees.

FIG. 2 shows that the base 12 is a generally rectangular enclosure having a rear wall 32, a top wall 34, a bottom wall 36 and side walls 27 and 38. As illustrated in FIG. 5, the base 12 is sized and shaped to hold the water panel assembly or wet pack comprised of the water panel 16, the scale control insert 18 and the distribution tray 24. Top wall 34 is formed with an opening 40 plugged by a cap 41 for a purpose to be appreciated hereafter and carries a first latch 42 thereon. Bottom wall 36 is provided with a drain hole 44 within which drain spud 28 is received, and also carries a second latch 46 in spaced apart alignment with the first latch 42. Opening 40 and drain hole 44 are similarly sized as will be understood later. Side wall 38 is designed to include a damper adapter 48 which accommodates a furnace duct or pipe as shown in phantom lines 50 in FIG. 1. As is known, the adapter 48 usually carries a pivotally mounted, damper plate 52 which is controlled by a rotatable handle 54. Cover 14 has a curved outer wall 56 and side walls 58 and 60 (FIG. 3). The top of cover 14 is provided with a first catch 62 which receives first latch 42 in a snap fit without fasteners. The bottom of cover 14 is similarly provided with a second catch 64 (FIG. 3) which receives second latch 46 in a snap fit without fasteners. In FIG. 2, humidifier 10 has its two part housing 12, 14 in a left hand inlet mode, that is, the furnace pipe adapter 48 is physically located on the left side to cooperate with the existing furnace pipe or duct 50, while the solenoid valve 26 is located on the right. However, in accordance with the invention, the housing 12, 14 is easily and conveniently reversed or converted, as shown in FIG. 3, to a right hand inlet mode in the event the furnace pipe or duct 50 or plumbing dictate such orientation.

To accomplish such conversion, the cover 14 in FIG. 2 is separated from the base 12 by disengaging or unsnapping the latches 42, 46 from the catches 62, 64. The water panel assembly or wet pack consisting of water panel 16, scale control insert 18 and distribution tray 24 is removed as are the drain spud 28 and cap 41 from base 12. Then, the base 12 and the cover 14 are rotated 180 degrees as shown in FIG. 3, with drain spud 28 reinstalled in opening 40 and cap 41 reinstalled in drain hole 44 (FIG. 4). The similar sizing of opening 40 and drain hole 44 permit the interchangeability of drain spud 28 and cap 41. Lastly, the wet pack 16, 18, 24 is reinserted in the base 12 again with the distribution tray 24 at the top, and cover 14 is again closed onto the base 12 using the snap fit latches 42, 44 and the catches 62, 64. It is important to note that the distributor 24 and wet pack do not have to be reversed. Installation is completed by attaching the furnace duct 50 to the reversed adapter 48 and making the necessary plumbing connections to connect feed tube 20 with the water supply.

Figure 6:
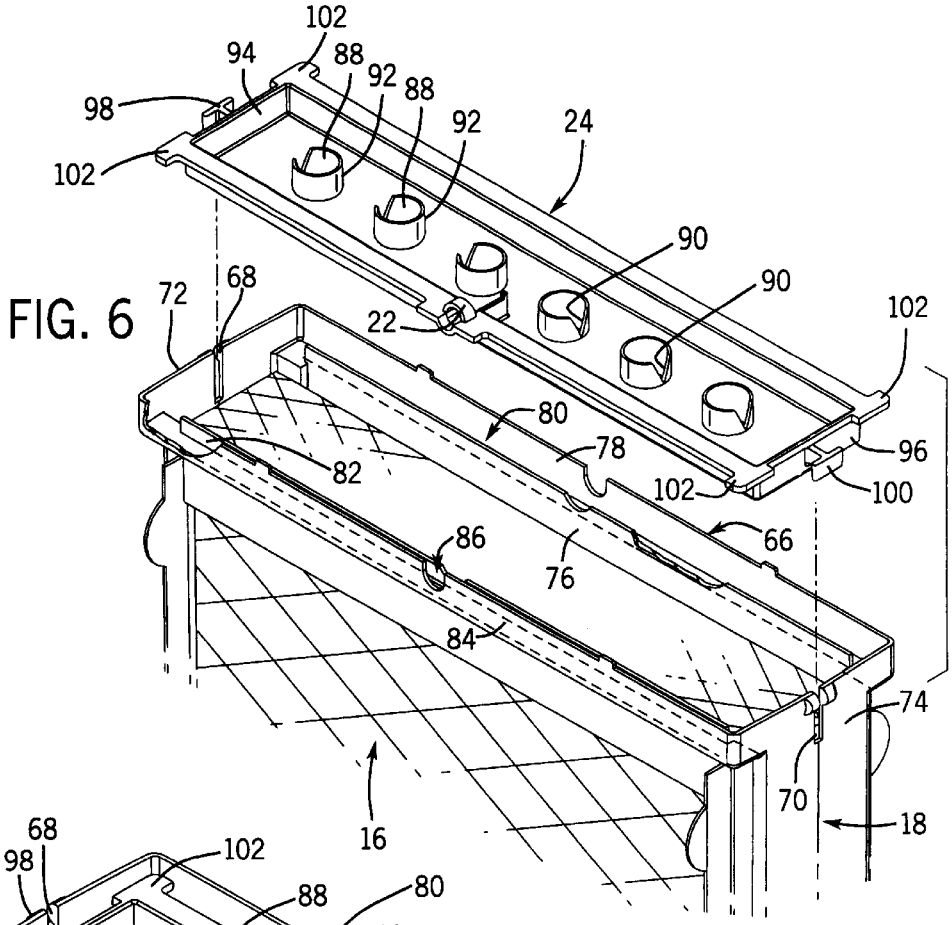
FIG. 6 is a partial, exploded, perspective view of a distribution tray removed from a scale control insert of the water panel assembly.
Figure 7:
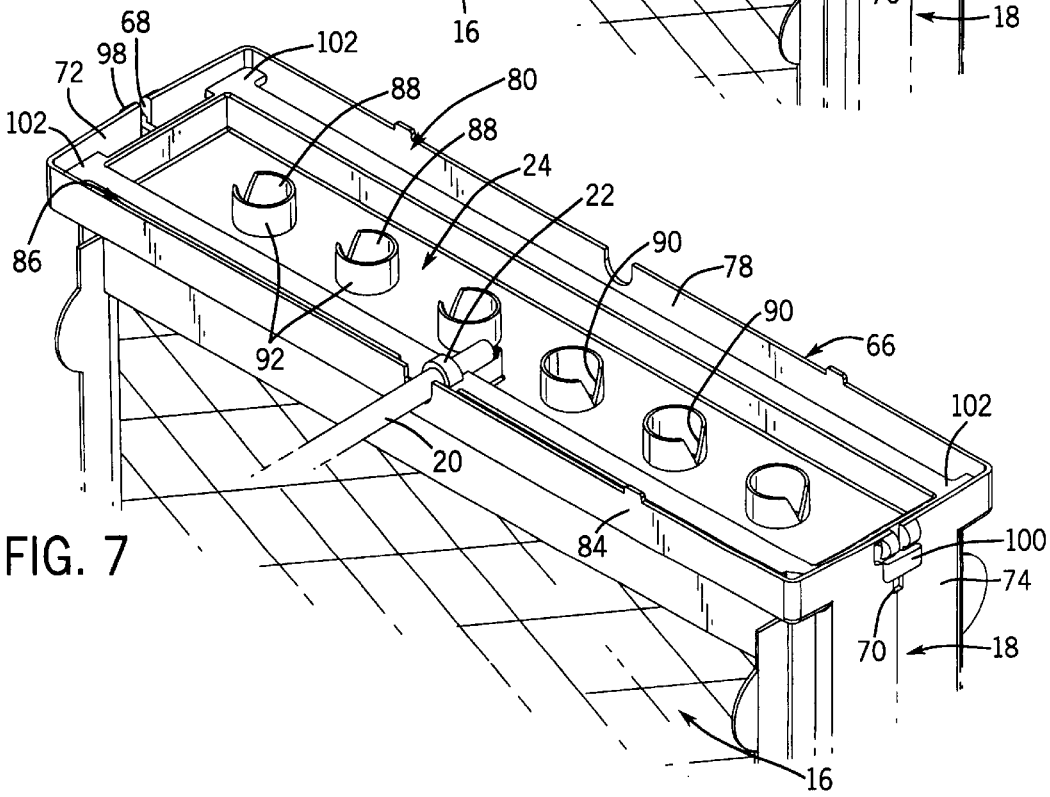
FIG. 7 is a perspective view of the distribution tray placed inside the scale control insert.

Further in accordance with the invention, FIGS. 6 and 7 show details of the scale control insert 18 and distribution tray 24 which is equipped with integral overflow protective structure. The top portion of the scale control insert 18 includes a generally rectangular, upstanding skirt 66 formed with vertical slots 68, 70 on its end panels 72, 74. Skirt 66 is molded with a first upstanding vertical wall 76 which is parallel to and spaced from one side panel 78 to form a first, longitudinally extending, overflow channel 80 therebetween. A second upstanding vertical wall 82 is parallel to and spaced from another side panel 84 to create a second, longitudinally extending, overflow channel 86 therebetween. Distribution tray 24 is formed with a series of spaced apart, circular, discharge openings 88 provided with V-shaped notches or weirs 90 on cylindrical risers 92. The weirs 90 are used to evenly spread water from tube 20 along the top of the water panel 16. The length of distribution tray 24 is sized to cover the entire top portion of the water panel 16. The opposed respective ends 94, 96 of the distribution tray 24 are formed with respective T-shaped tabs 98, 100 which snap fit into the slots 68, 70 on skirt 66. The width of distribution tray 24 is sized to fit between the walls 76 and 82 on skirt 66. Distribution tray 24 is also formed with the comer shoulders 102 which fit into corresponding recesses at the end of walls 76 and 82.

Should the distribution tray 24 overflow because of blocked weirs or because of a scale build up due to mineral deposits, the water will go up over the shoulders 102, and walls 76 and 82 into channels 80 and 86. The water will flow along the channels 80 and 86 to the ends of the scale control insert 18 and travel downwardly between the water panel 16 and the end of the scale control insert 18 to the drain hole 44. Overflow water is thus controllably channeled inside the scale control insert rather than outside so that puddles will not form and excess moisture will not be blown into the furnace system.

It should now be understood that the present invention provides an improved humidifier having a two part housing which may be easily reversed to match existing environmental structure without the need for any tools, without any fasteners and without reversing the wet pack. The simplicity of employing a two part housing with snap fit latch structure and interchangeable drain holes improves over prior art three piece housing with multiple fasteners which require time to remove and reinstall. The present invention also provides a useful, economical structure for handling overflow of water in the distribution tray in the event of blockage or mineral build up. Such structure reduces maintenance and prevents damage to components in the furnace system.

While the invention has been described with reference to a preferred embodiment, those skilled in the art will appreciate that certain substitutions, alternations and omissions may be made without departing from the spirit thereof. Accordingly, the foregoing description is meant to be exemplary only, and should not be deemed limitative on the scope of the invention set forth with the following claims.

I claim:

1. A humidifier comprising:

a base having an adapter in a first position adapted to be connected to a furnace duct, the base housing a water panel assembly and a water feed tube to supply water to a water distribution structure disposed on top of the water panel assembly; and a cover movably connected to the base, wherein only the base and the cover are rotatable independent of the water distribution structure to place the adapter in a second position to adapt to a different furnace duct, and the base and cover are snap fit together without fasteners wherein the water panel assembly is comprised of a scale control insert, an evaporative water panel held within the scale control insert and a distribution tray retained within the scale control insert above the water panel, and wherein the scale control insert is formed with an upstanding skirt having opposing end panels formed with slots therein, a first upstanding vertical wall parallel and spaced from a first side panel to form a first overflow channel therebetween, and a second upstanding vertical wall parallel to and spaced from a second side panel to form a second overflow channel therebetween, whereby any excess water in the distribution tray will travel over the first and second walls into the first and second overflow channels and flow downwardly between the water panel and the end panels of the scale control insert to a drain.

2. The humidifier of claim, 1 wherein the base with the adapter in the first position has a top opening in which a cap is removably attached, and a bottom opening in which a drain spud is removably inserted, and wherein the base with the adapter in the second position has the top opening and the bottom opening interchanged such that the cap is removably fastened in the bottom opening and the drain spud is removably inserted into the top opening.

3. The humidifier of claim 1, the base and the cover are provided with mating latch and catch structure on top and bottom portions thereof.

4. The humidifier of claim 1, wherein the distribution tray is provided with tabs which fit in the slots of the skirt.

5. The humidifier of claim 4, wherein the distribution tray is sized to fit within the end panels and the vertical walls of the skirt.

6. A humidifier comprising:

a base adapted to be connected to a furnace duct, the base housing a water panel in a water panel framework, and a water feed tube for supplying water to a distribution tray disposed in the water panel framework above the water panel; and a cover removably connected to the base, wherein the water panel framework is provided with overflow structure for directing and confining any overflow of water in the distribution tray within the water panel framework, wherein the overflow structure is comprised of a pair of overflow channels disposed longitudinally on opposite sides of the distribution tray.

7. A humidifier comprising:

a two piece reversible housing snap fit together for holding a water panel assembly and a water feed tube to supply water to a distribution structure disposed on top of the water panel assembly, the water panel assembly being provided with an overflow arrangement for controlling any overflow of water in the distribution structure, the overflow arrangement being comprised of a pair of overflow channels disposed longitudinally on opposite sides of the distribution structure.

* * * * *